US006178953B1

(12) United States Patent
Cox

(10) Patent No.: US 6,178,953 B1
(45) Date of Patent: Jan. 30, 2001

(54) MAGNETIC FLUID TREATMENT APPARATUS FOR INTERNAL COMBUSTION ENGINE AND METHOD THEREOF

(76) Inventor: Virgil G. Cox, 3035 Manchester Ct., Gastonia, NC (US) 28056

( * ) Notice: Under 35 U.S.C. 154(b), the term of this patent shall be extended for 0 days.

(21) Appl. No.: 09/517,973

(22) Filed: Mar. 3, 2000

Related U.S. Application Data

(60) Provisional application No. 60/122,855, filed on Mar. 4, 1999.

(51) Int. Cl.[7] ..... F02M 27/04
(52) U.S. Cl. ..... 123/536; 123/537
(58) Field of Search ..... 123/536, 537, 123/538, 539; 210/222, 695; 261/1

(56) References Cited

U.S. PATENT DOCUMENTS

| | | | | |
|---|---|---|---|---|
| 4,414,951 | * | 11/1983 | Saneto | 123/536 |
| 4,460,516 | * | 7/1984 | Kapitanov et al. | 123/537 |
| 4,461,262 | * | 7/1984 | Chow | 123/538 |
| 4,711,271 | * | 12/1987 | Weisenbarger et al. | 123/538 |

* cited by examiner

*Primary Examiner*—Marguerite McMahon
(74) *Attorney, Agent, or Firm*—Dougherty & Clements LLP

(57) ABSTRACT

A magnetic fluid treatment apparatus is embedded within or mounted adjacent an air and fuel mixing or injecting device for internal combustion engines. The apparatus includes a plurality of magnets arranged to produce a strong, focused magnetic field perpendicular to the direction of flow of the air and fuel mixture within the fuel mixing chamber. The magnets are positioned downstream from the discharge nozzle from the main jet of the fuel mixing chamber or injecting device at a point where the velocity of the air and fuel mixture is at or near its maximum, thus providing optimal utilization of the magnetic fields generated by the magnets. The magnets may be embedded in a carburetor wall with a north polarity end of a first magnet oriented toward and in close proximity to a south polarity end of a second magnet. The magnets may also be positioned adjacent the external surface of the carburetor wall with a north polarity end of a first magnet oriented toward and in close proximity to a north polarity end of a second magnet. A method of magnetic treatment of fluids and gaseous fuel mixtures within internal combustion engines is also disclosed.

17 Claims, 6 Drawing Sheets

MAGNETIC FLUID TREATMENT APPARATUS FOR INTERNAL COMBUSTION ENGINE AND METHOD THEREOF

CROSS REFERENCE TO RELATED APPLICATION

This application claims the benefit of U.S. Provisional Application No. 60/122,855, filed Mar. 4, 1999.

FIELD OF THE INVENTION

The present invention relates to a magnetic fluid treatment method and apparatus for reducing the noxious emissions of internal combustion engines. More particularly, the invention is a magnetic fluid treatment apparatus providing a strong, focused magnetic field that is attached near or within an air/fuel mixing or injecting device.

BACKGROUND OF THE INVENTION

Magnetic apparatuses have been used for many years for the treatment of fluids, and in particular, for treating water, gasoline, or other fuel mixtures in both the liquid and gaseous state. The mechanism of operation of the magnetic apparatuses is based on a Lorentz Force, which is a resultant of the interaction of the magnetic field(s) of appropriately located magnets with moving ionic and atomic charges within a fluid or fluid spray. The magnetic interactions cause positive and negative charges within the moving fluid or fluid spray to alter trajectory, thereby causing collisions of supermolecules, or large molecules, and compounds in the fluid, which break apart these large molecules and compounds. "Supermolecules" are agglomerations of molecules. The resulting smaller molecules and compounds withing the moving fluid or fluid spray provide for improved mixing with air and other gases, and allow more complete combustion of fluid fuel or fluid spray thereof. The primary limitation of the prior apparatuses is the relatively slow movement of the fluid through the magnetic field. This limitation is because the speed of the positive and negative charges within the fluid or fluid spray media is a major contributor in creating the Lorentz Force, and thus, the subsequent breaking apart of the large molecules. A need exists for providing a treatment method and apparatus for air and fuel mixtures for an internal combustion engine to decrease noxious emissions of the engine.

OBJECTS OF THE INVENTION

The principal object of the present invention is to provide an improved magnetic fluid treatment apparatus for reducing the noxious emissions of engines which bum liquid or gaseous fuel mixtures with air.

Another object of the invention is to provide a magnetic fluid treatment apparatus having a strong, focused magnetic field that can be embedded within or mounted adjacent to a carburetor or another air and fuel mixing device.

A further object of the present invention is to provide a magnetic fluid treatment apparatus capable of generating a magnetic field having sufficient strength to affect a rapidly moving air and fuel mixture.

Another object of the invention is to provide a method for creating a magnetic field in a fuel delivery system at the point of maximum fuel mixture velocity

SUMMARY OF THE INVENTION

The present invention employs magnets positioned in close proximity to a fuel atomizing device such as a carburetor, injector, or other air/fuel mixing device. The magnetic fluid treatment apparatus generates a strong, focused magnetic field within the air and fuel stream immediately following the fuel mixing or dispensing device (i.e., venturi, nozzle, atomizer, spray jet, etc.). Preferably, the magnets are embedded within the wall of the carburetor in the vicinity of the primary venturi, a location within the carburetor where the air and fuel stream velocity is at a maximum. In another embodiment, the magnets are mounted adjacent the external surface of the wall of the carburetor downstream from the main fuel discharge jet. The position of the magnets within or adjacent to the carburetor maximizes the Lorentz Force by treating the air and fuel mixture in the carburetor at the point in the internal combustion engine where the speed of the fuel is at its maximum, thus resulting in the optimum utilization of the magnetic field generated by the magnets of the magnetic fluid treatment apparatus.

The magnetic fluid treatment apparatus uses modern technology magnetic materials to ensure that the magnetic field is as strong as is presently technologically achievable. The magnets are preferably made from a neodymium alloy such as neodymium-iron-boron ($Nd_2Fe_{14}B$), but also can be made from selenium cobalt or samarium cobalt alloys. However, the use of lesser strength magnetic fields is not excluded and will likewise result in an improved level of emissions reduction over the present state of the art. If multiple, adjoining magnets are used, the magnets are preferably bonded or glued together in a clamp or bracket. Because neodymium alloy magnets are prone to oxidation, it is preferred that they be coated to inhibit oxidation. This can be accomplished by electroplating the magnets, painting the magnets or encasing the magnets in resin.

BRIEF DESCRIPTION OF THE DRAWINGS

The foregoing and other objects will become more readily apparent by referring to the following detailed description and the appended drawings in which.

DETAILED DESCRIPTION OF THE PREFERRED EMBODIMENTS

Figure 1:
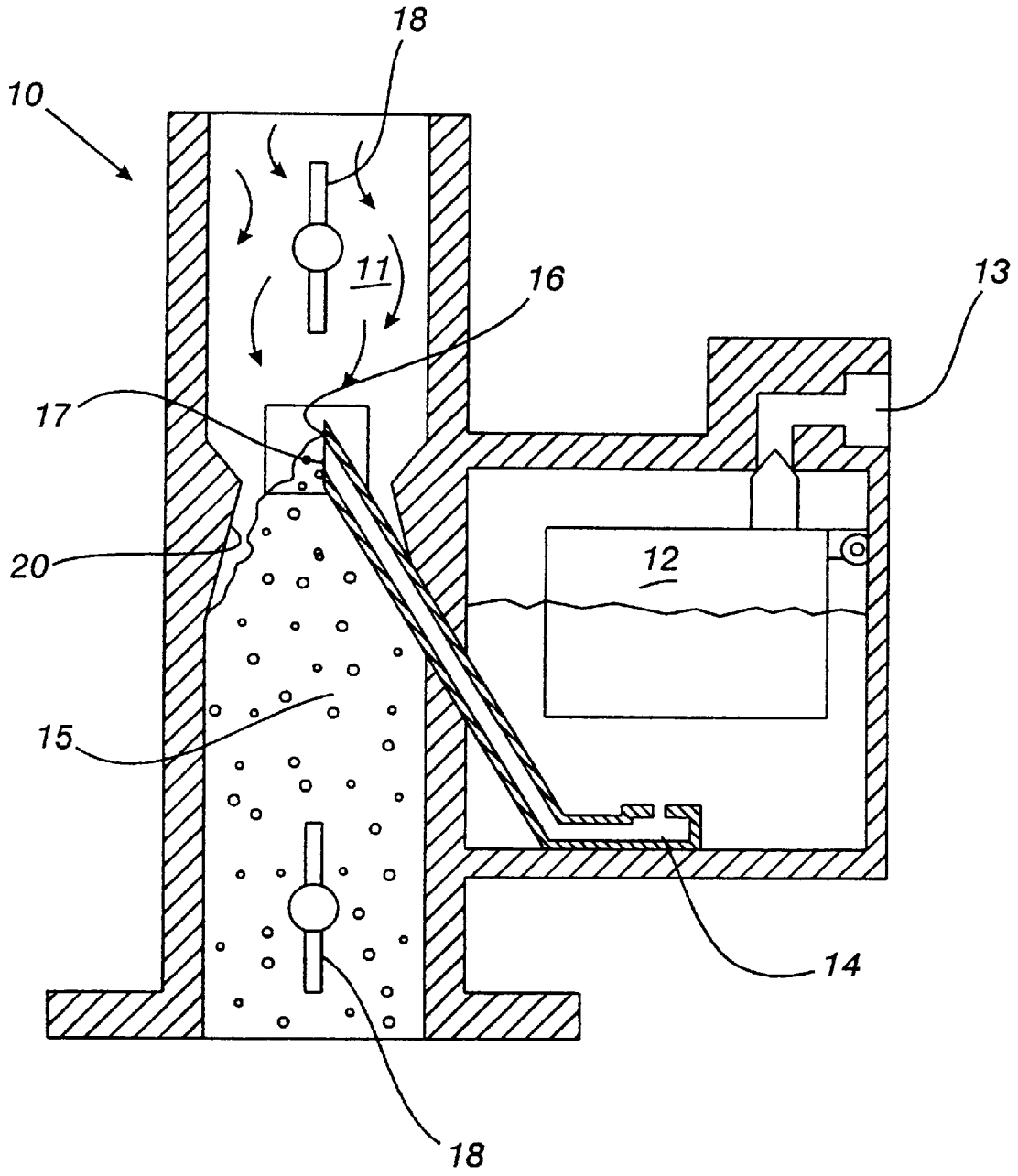
Fig.1 (PRIOR ART)
FIG. 1 is a longitudinal cross section of a carburetor of a typical engine that burns a liquid or gaseous mixture of liquid fuel and air, such as a conventional gasoline engine.

The following discussion of magnetic fluid treatment in general provides a basis for predicting the characteristics of the magnets of a magnetic fluid treatment apparatus that are required to achieve the optimum effect. The characteristics are the strength of the magnetic field generated by the magnets, the degree of focus of the magnetic field, the length of time the magnetic field acts on the moving air/fuel mixture and the speed (i.e., velocity) of the air/fuel mixture. As the strength of the magnetic field is increased, the force on the charges and dipoles is increased and the energy is transformed into activation energy in the air/fuel mixture. Accordingly, stronger magnets generally yield better results.

However, since magnetic fields disperse exponentially in the area around the magnet, even a strong magnet next to a fluid conduit can result in a relatively weak magnetic field inside the conduit if the magnetic field is not focused. Magnets can be configured such that their magnetic field is focused inside the conduit perpendicular to the direction of the fluid flow. Further, since the air and fuel mixture is moving, the length of time that the air and fuel mixture is exposed to the magnetic field determines the percentage of the mixture that is modified by the magnetic treatment. The velocity of the air and fuel mixture is a major contributor in creating the Lorentz Force which breaks apart the large molecules, because speed of the positive and negative charges within the fluid or fluid spray media is a major contributor in the subsequent breaking apart of the large molecules. The breaking apart of the large molecules is created when the positive or negative charges on the large molecules are affected by the magnetic fields induced by the configuration of the magnets. The large, undispersed molecules are moved off-line from the trajectory of the other molecules and the undispersed molecules impact other molecules and form smaller molecules, therefore creating greater dispersion of the fuel molecules within the air media and encouraging more efficient combustion of the fuel within the engine. Thus, the velocity of the air and fuel mixture greatly influences the overall effectiveness of the magnetic treatment of air and fuel mixtures within internal combustion.

The magnetic fluid treatment apparatus of the invention uses magnetic materials incorporating recent technological advances that are known in the art to ensure that the magnetic field is as strong as is presently achievable. The magnets are preferably made from a neodymium alloy such as neodymium-iron-boron ($Nd_2Fe_4B$), but also can be made from selenium cobalt or samarium cobalt alloys. However, the use of materials generating lesser strength magnetic fields is not excluded and would likewise result in an improved level of emissions reduction over the present state of the art. If multiple, adjoining magnets are used, the magnets are preferably bonded or glued together in a proper configuration as demonstrated in FIGS. 4 through 6.

The neodymium alloy magnets are prone to oxidation, therefore it is preferred that they be coated to inhibit oxidation. This process can be accomplished by electroplating the magnets, painting the magnets or encasing the magnets in resin. When the magnets are encased or encapsulated in resin, it is preferred that the resin encased magnets are protected by an elongated container having a rectangular bottom, a pair of rectangular side walls connected to the bottom and a pair of end pieces connected to the bottom and to each of the rectangular side walls. The top of the magnets, and the clamp, or the bracket holding the magnets, are configured to conform to the exterior surface of the wall of the carburetor.

FIG. 1 is a longitudinal cross section of a fuel atomizing chamber, commonly named a carburetor 10 of a typical internal combustion engine that ignites a liquid or gaseous mixture of fuel and air, such as a conventional gasoline or diesel engine. The carburetor 10 includes a cylindrical throat 11, 20, 15 and a fuel 12. The fuel storage area 12 has a fuel inlet 13 that is in fluid communication with a remote fuel tank (not shown). A main jet 16 is supplied with fluid from the base of the fuel storage area 12 to deliver the fuel in the fuel storage area to the throat 20 of the carburetor 10 through a main discharge tube 14. The main discharge tube 14 terminates in a discharge nozzle 17, thereby forming a secondary venturi for aspirating the fuel into the air stream within the throat (primary venturi) 20 of the carburetor 10 when the throttle 18 is in the open position. Thereafter, the air/fuel mixture flows through the primary venturi 20 for a purpose to be described hereafter. The preceding description of the carburetor 10 is exemplary only and is not intended to limit the scope of the invention. The magnetic fluid treatment apparatus of the invention may be utilized with any known carburetor or other air/fuel mixing device in the manner described herein.

Figure 2:
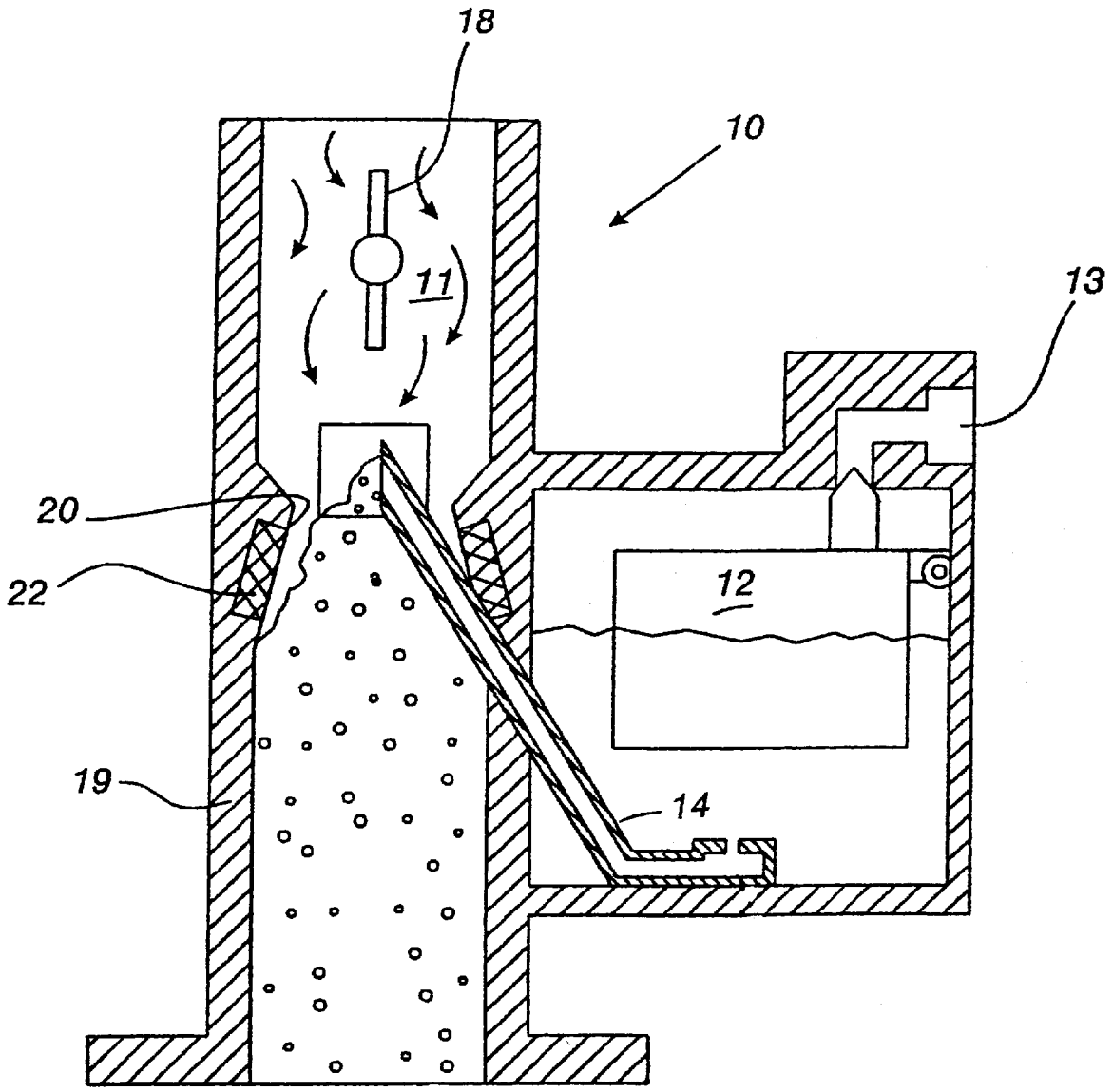
FIG. 2 is a longitudinal cross section of the carburetor of FIG. 1 including a plurality of magnets embedded within the wall of the carburetor in the vicinity of the primary venturi in accordance with the present invention.

In the preferred embodiment of the invention illustrated in FIG. 2, a plurality of venturi area magnets 22 are optimally positioned to produce a strong, focused magnetic field within the location of highest velocity of air and fuel mixture flow. The strength, as measured by the gauss level, of each of the venturi area magnets 22 can be varied from about 1000 gauss to the maximum capacity of the neodymium-iron-boron or samarium cobalt alloy. In a preferred embodiment, however, each of the venturi area magnets 22 has a minimum strength of at least 2000 gauss. The magnets 22 are embedded within the wall 19 of the carburetor 10 in the vicinity of the primary venturi 20. Accordingly, the magnetic field generated by the venturi area magnets 22 acts at the point in the fuel system where the velocity of the air/fuel mixture is the greatest, thus resulting in the optimum utilization of the magnetic field generated by the magnetic fluid treatment apparatus.

Figure 3:
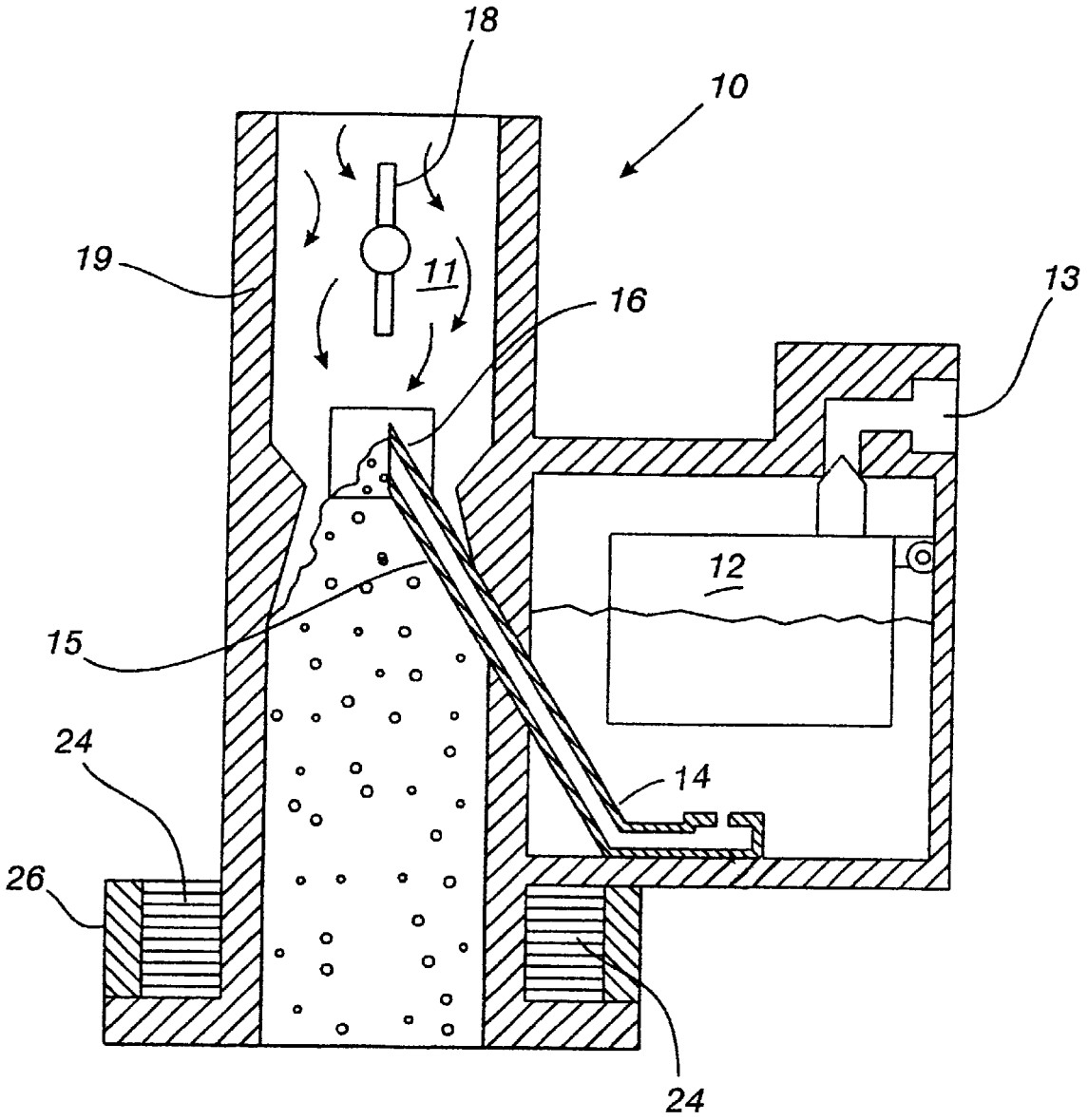
FIG. 3 is a longitudinal cross section of the carburetor of FIG. 1 including a plurality of magnets mounted adjacent the external surface of the wall of the carburetor downstream from the discharge nozzle leading from the main jet of the fuel mixing chamber and a ferromagnetic clamp for short circuiting the magnetic field exterior of the apparatus.
Figure 5:
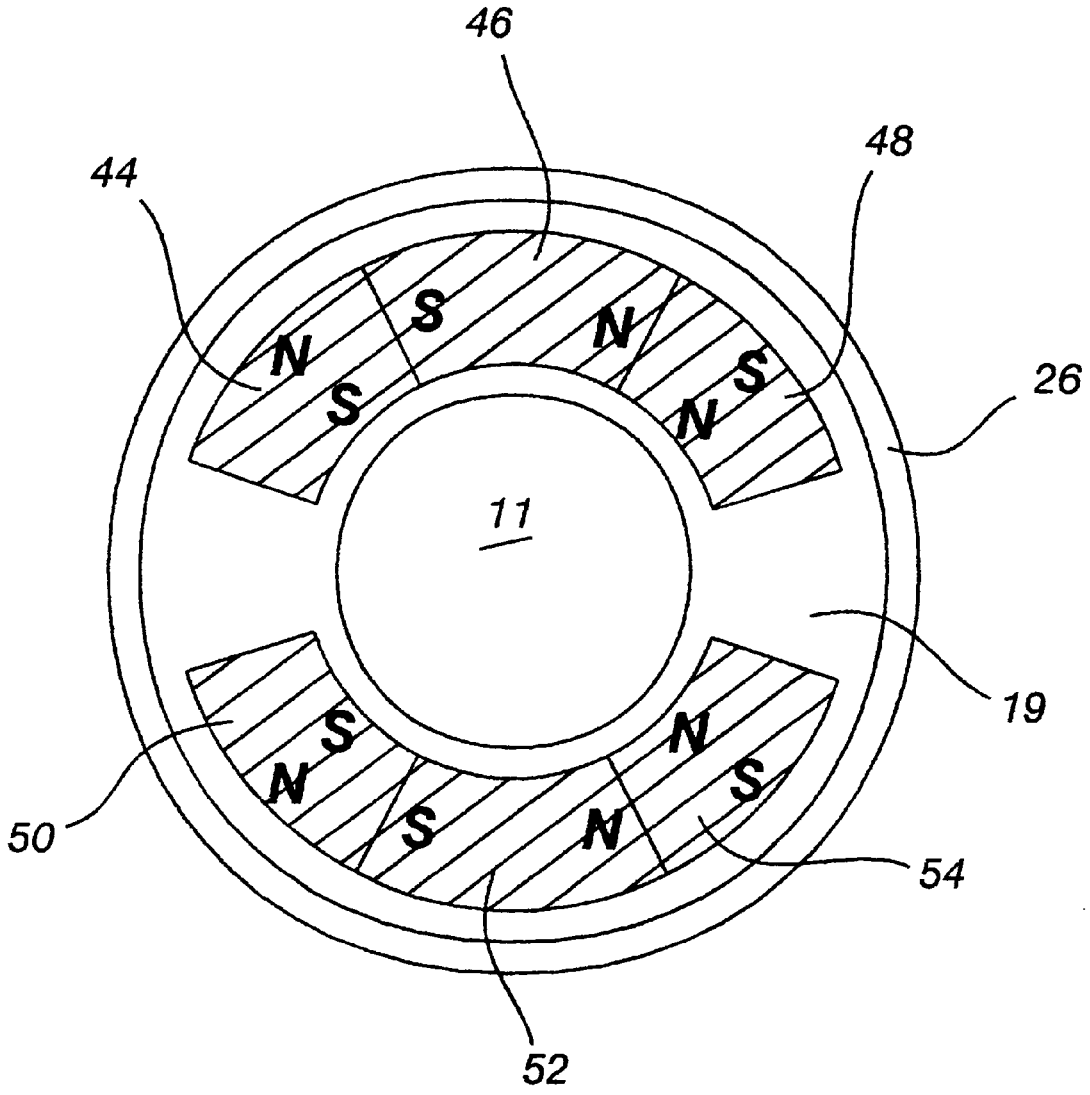
FIG. 5 is a transverse cross section of another arrangement of a plurality of magnets and a ferromagnetic clamp according to the invention.

FIG. 5 is a transverse cross section of the preferred configuration of a plurality of magnets 22 of FIG. 2 or 24 of FIG. 3, and a ferromagnetic clamp 26 according to the invention. The arrangement of the magnets 22 comprises a first set of three magnets 44, 46,48 and a second set of three magnets 50, 52, 54. The magnets 44 through 74 may be embedded within the wall 19 of the carburetor 10 as shown in FIG. 2. However, the magnets 44 through 54 may also be positioned between the external surface of the wall 19 of the carburetor and the ferromagnetic clamp 26 is positioned adjacent the exterior surface of the wall of the carburetor as shown in FIG. 3.

Figure 6:
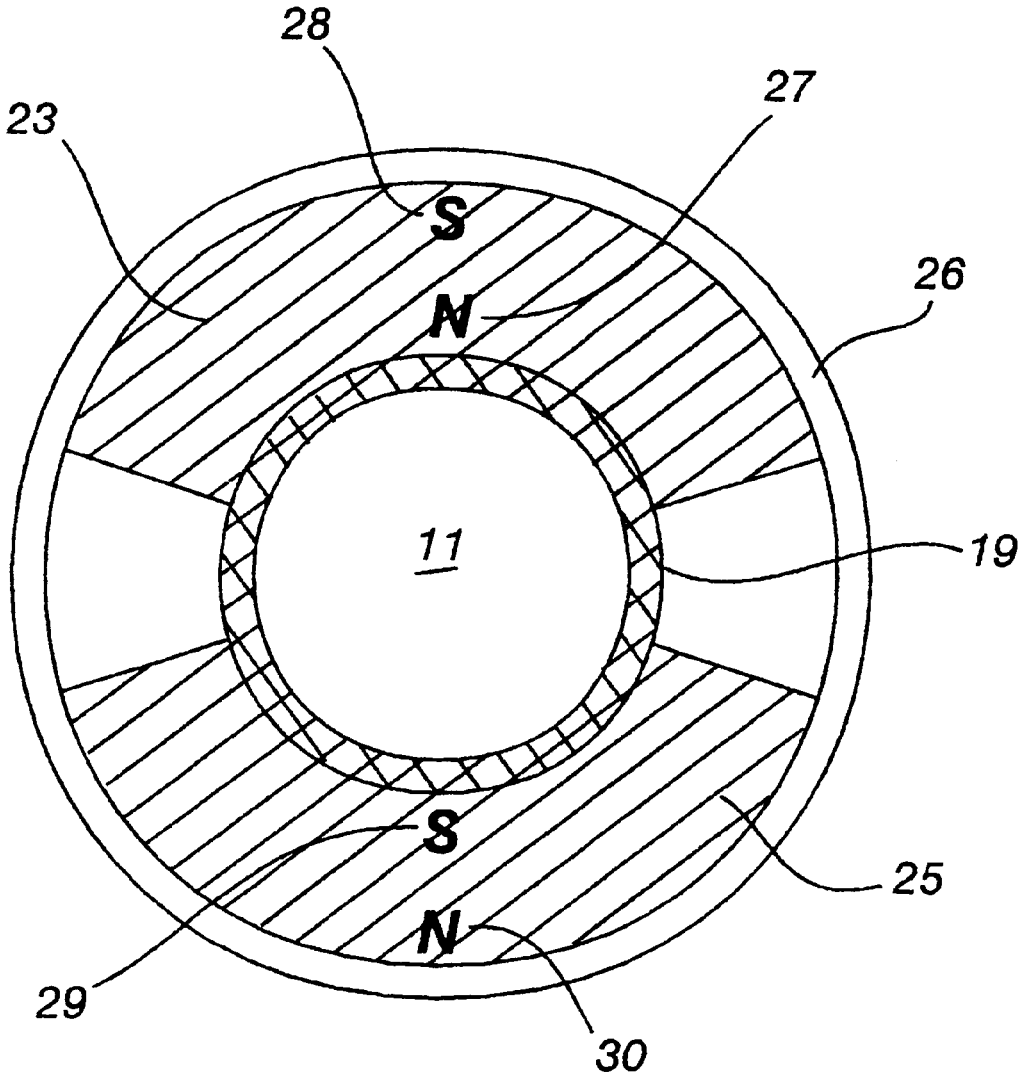
FIG. 6 is a transverse cross section of another alternative arrangement of a plurality of magnets and a ferromagnetic clamp according to the invention.

The magnets 64, 66 68, 70, 72, 74 are arranged as illustrated in FIG. 6. Preferably, each set of magnets is encased or encapsulated in resin or other non-ferromagnetic rigid material, within a semi-rigid or rigid container, as previously described, to hold the magnets securely together. As previously mentioned, the magnets 44 through 54 are preferably made from a neodymium alloy such as neodymium-iron-boron ($Nd_2Fe_{14}B$), but also can be made from selenium cobalt or samarium cobalt alloys. In the arrangement shown, the magnets 44 through 54 generate a strong, focused magnetic field perpendicular to the direction of flow of the air/fuel mixture in the throat of the carburetor. Thus, the magnetic field acts directly on the rapidly moving air/fuel mixture to optimize the effectiveness of the magnetic fluid treatment apparatus.

FIG. 6 is a transverse cross section of one arrangement of at least two magnets 23, 25 and a ferromagnetic clamp 26 according to the invention. The preferred external arrangement of the magnets includes a first magnet 23 and a second magnet 25. As shown in FIG. 6, the magnets 23, 25 are positioned between the exterior surface of the wall 19 of the carburetor and the ferromagnetic clamp 26. However, the magnets 23, 25 may also be embedded within the wall 19 of the carburetor similar to what is shown in FIG. 4 or 5.

The first magnet 23 comprises an inner portion 27 adjacent the external wall of the carburetor and an outer portion 28 adjacent the ferromagnetic clamp 26. The inner portion 27 has a north polarized end and the outer portion 28 has a south polarized end. The second magnet 30 likewise comprises an inner portion 29 and an outer portion 30. However, the inner portion 29 has a south polarized end and the outer portion 30 has a north polarized end. The orientation of the polar north and south ends of each magnet allow for a concentration of magnetic forces within the cylinder area 15. As previously mentioned, the magnets 23, 25 are preferably made from a neodymium alloy such as neodymium-iron-boron ($Nd_2Fe_{14}B$), but also can be made from selenium cobalt or samarium cobalt alloys.

Figure 4:
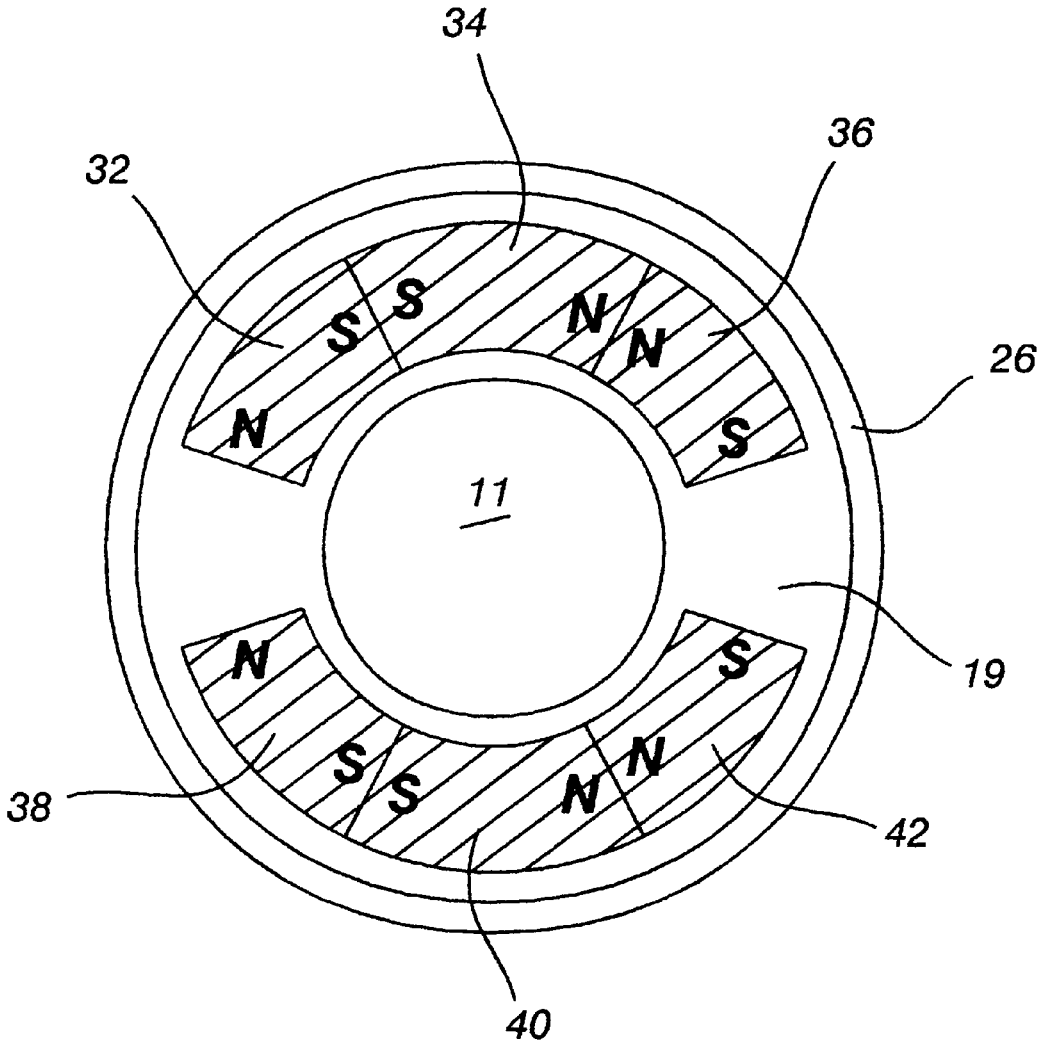
FIG. 4 is a transverse cross section of one arrangement of at least two magments and a ferromagnetic clamp according to the invention.

FIG. 4 is a transverse cross section of an alternative arrangement of a plurality of venturi area magnets 22 of FIG. 2 or of throat area magnets 24 of FIG. 3, and a ferromagnetic clamp 26 according to the invention. The arrangement of the magnets may be comprised of a first set of three magnets 32, 34, 36 and a second set of three magnets 38, 40, 42. The magnets 32, 34,36, 38, 40, 42 may be embedded within the wall 19 of the carburetor 10 as shown in FIG. 2. However, the magnets 32, 34, 36, 38, 40, 42 may also be positioned between the external surface of the wall 19 of the carburetor and the ferromagnetic clamp 26 as shown in FIG. 3.

Each of the magnets 32, 34, 36, 38, 40, 42 has opposed transverse sides. At least one of the opposed transverse sides of each magnet 32 through 42 abuts another of the magnets. As shown, the opposed transverse sides have opposite polarizations and the magnets are arranged such that like polarizations of adjacent magnets abut one another (see FIG. 4). In other words, the first set of magnets 32 through 36 and the second set of magnets 38 through 42 are arranged such that north polarized ends abut north polarized ends and south polarized ends abut south polarized ends. Preferably, each set of magnets is encased or encapsulated in resin or other non-ferromagnetic rigid material, within a semi-rigid or rigid container, as previously described, to hold the magnets securely together. As previously mentioned, the magnets 32 through 42 are preferably made from a neodymium alloy such as neodymium-iron-boron ($Nd_2Fe_{14}B$), but also can be made from selenium cobalt or samarium cobalt alloys.

In operation, the magnetic fluid treatment apparatus of the invention is embedded within or mounted adjacent a carburetor or other air/fuel mixing device. The magnetic field generated by the magnetic fluid treatment is focused inside the throat of the carburetor and perpendicular to the direction of flow of the air/fuel mixture at the point in the fuel system where the velocity of the air/fuel mixture is at or near its maximum. Thus, the position and arrangement of the magnets of the magnetic fluid treatment apparatus results in the optimum utilization of the magnetic field generated by the magnetic fluid treatment apparatus.

Test Results

A series of emissions tests were conducted on a 1998-manufactured lawn mower which had its exhaust muffler modified to accept the probe of an emission analyzer. These tests were accomplished with a Bear BAR 90 automobile testing machine with a NC State Emissions program. The equipment had been calibrated on Dec. 16, 1998 to ensure proper operability. The test sequence consisted of setting up the equipment, warming up the lawn mower engine for twenty minutes to ensure that the emission readings were reasonably stable, taking five reading at ten minute intervals to establish a base line emission profile, placing two magnets (in approximately the orientation described in this document) on the intake manifold between the carburetor and the engine block, and taking four sets readings. (A fifth reading could not be taken because the mower ran out of gas.)

These test results were:

Warm-up: 20 minute

| Reading | Time(min) | HC(ppm) | CO(%) |
|---|---|---|---|
| TEST 1 NO MAGNET | | | |
| 1 | 0 | 196 | 6.22 |
| 2 | 10 | 196 | 7.60 |
| 3 | 20 | 177 | 7.91 |
| 4 | 30 | 182 | 7.80 |
| 5 | 40 | 176 | 7.44 |
| TEST 2 MAGNETS INSTALLED (Clock reset) | | | |
| 1 | 0 | 145 | 6.39 |
| 2 | 10 | 167 | 6.98 |
| 3 | 20 | 211 | 7.61 |
| 4 | 30 | 147 | 7.01 |

The RPM remained within 5% and timing remained at 0.0 Before Top Dead Center (BTDC) throughout the tests. Traditional analysis of this data shows the following results:

| | Average | Standard Deviation | Range |
|---|---|---|---|
| Test 1 (No magnets) | | | |
| HC Readings | 185.5 ppm | 5.0 ppm | 180–190 ppm |
| CO Readings | 7.39% | 0.34% | 7.05–7.73% |
| Test 2 (Magnets installed) | | | |
| HC Readings | 167.5 ppm | 17.6 ppm | 150–186 ppm |
| CO Readings | 7.00% | 0.29% | 6.61–7.29% |

Interpretation: The averages are clearly different though the ranges have a small overlap for both the HC and CO data. Use of the Mann-Whitney confidence test indicates that the averages for the HC data are not statistically equal at the 31% level. Though this confidence is not at the traditional 5% level, the data show that the changes that occurred that are consonant with the theory. Of great significance is the fact that both the HC and the CO data support this conclusion.

ALTERNATIVE EMBODIMENTS

The magnetic fluid treatment apparatus and method may be utilized on any internal combustion engine, whether operating with gasoline, diesel, or other fuel, and whether large truck engines or small lawn mower four-cycle engines. The magnetic fluid treatment apparatus and method may also be utilized on a large boiler or other power generating device. The plurality of magnets may be placed inside, or around a fuel injection device or a carburetor of any internal combustion engine. The magnetic fields of the magnets may be generated by electromagnets also.

An alternative embodiment of the magnetic fluid treatment apparatus is shown in FIG. 3, depicting a longitudinal cross section of the carburetor 10 of FIG. 1 including a plurality of throat area magnets 24 mounted adjacent the external surface of the wall 19 of the carburetor. The magnets 24 are mounted downstream from the primary venturi 26 of the carburetor 10. A ferromagnetic clamp 26 in the form of an annular ring is provided around the outside of the magnet 24 for short circuiting the external magnetic field, thereby minimizing any stray magnetic field generated by the magnets. The ferromagnetic clamp 26 also serves to secure the arrangement of magnet 24 against the external surface of the wall 19 of the carburetor 10. Accordingly, the magnetic field generated by the magnet 24 acts at a point in the fuel system where the velocity of the air/fuel mixture is near its maximum, thus resulting in the effective utilization of the magnetic field generated by the magnetic fluid treatment apparatus.

SUMMARY OF ACHIEVEMENT OF THE OBJECTS OF THE INVENTION

From the foregoing, it is readily apparent that the invention provides a magnetic fluid treatment apparatus for reducing the noxious emissions of internal combustion engines which burn liquid or gaseous mixtures of fuel and air, such as gasoline or diesel engines. More particularly, the invention is a magnetic fluid treatment apparatus having a strong, focused magnetic field that can be embedded within or mounted adjacent a carburetor, an injector, or other air/fuel mixing device. A primary feature of the invention is that the position and arrangement of the magnets produces a magnetic field which is strong, focused, and properly located such that the magnetic field acts directly on the rapidly moving air/fuel mixture to optimize the effectiveness of the Lorentz Force which breaks apart the large molecules, because speed of the positive and negative charges within the fluid fuel or fluid spray thereof is a major contributor in the subsequent breaking apart of the large molecules. The breaking apart of the large molecules is created when the positive or negative charges on the large molecules are affected by the magnetic fields induced by the configuration of the magnets. The large, undispersed molecules are moved off-line from the trajectory of the other molecules and the undispersed molecules impact other molecules and form smaller molecules, creating greater dispersion of the fuel molecules within the air media and encouraging more efficient combustion of the fuel within the engine.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A magnetic treatment apparatus for treating fluids and gaseous fuel mixtures within internal combustion engines comprising:

a fuel atomizing chamber of an internal combustion engine, said fuel atomizing chamber having a plurality of magnets placed in close proximity to, and on opposing sides of said chamber;

said magnets being oriented adjacent to each other so that the north polarity end of a first magnet is oriented in close proximity to a second magnet, with each additional magnet of said plurality so oriented that the north polarity end is near a polarity end of the adjacent magnet; and a rigid enclosure holding said plurality of magnets, said enclosure focusing the magnetic fields of said magnets to the interior of said chamber.

2. The magnetic treatment apparatus of claim 1, wherein said plurality of magnets comprises at least two magnets, the north polarity end of said first magnet attachable on a first interior wall of said chamber, with the north polarity end of said first magnet oriented toward the south polarity end of said second magnet, said second magnet attachable on an opposing wall of said chamber.

3. The magnetic treatment apparatus of claim 1, wherein said plurality of magnets comprises magnets attachably adjoined to each other so that the north polarity end of said first magnet is oriented in close proximity to the north polarity end of said second magnet, with each additional magnet of said plurality of magnets oriented so that the north polarity end of said second magnet is adjoined to the north polarity end of the next magnet, and the south polarity end is adjoined to the south polarity end of the adjacent magnet of said plurality of magnets.

4. The magnetic treatment apparatus of claim 1, wherein said plurality of magnets comprises magnets attachably adjoined to each other so that the north polarity end of said first magnet is oriented perpendicular to the north polarity end of said second magnet, with each additional magnet of said plurality of magnets oriented so that the north polarity end is perpendicular to the north polarity end of the adjacent magnet of said plurality of magnets, and the south polarity end of each magnet is perpendicular to the south polarity end of the adjacent magnet of said plurality of magnets.

5. The magnetic treatment apparatus of claim 1, wherein said fuel atomizing chamber further comprises a carburetor including air and fuel mixtures therein, said carburetor having an interior location therein where the velocity of said air and fuel mixtures is at or near its maximum velocity, said plurality of magnets oriented adjacent to said interior location.

6. The magnetic treatment apparatus of claim 5, wherein said magnets are embedded within the wall of the carburetor in the vicinity of said interior location of said carburetor.

7. The magnetic treatment apparatus of claim 5, wherein said magnets are mounted adjacent an external surface of the wall of said carburetor downstream from a fuel discharge jet of the carburetor.

8. The magnetic treatment apparatus of claim 1, wherein said magnets are mounted adjacent the external surface of fuel injectors mounted within the wall of said carburetor.

9. The magnetic treatment apparatus of claim 1, wherein said rigid enclosure further comprises a clamp that secures said plurality of magnets so that the magnetic field from said north polarity end of said first magnet is oriented to overlap the magnetic field from said second magnet, with each additional magnet of said plurality of magnets is oriented so that the magnetic field from each north polarity end is oriented to overlap the magnetic field from at least one of each additional magnet of said plurality of magnets.

10. The magnetic treatment apparatus of claim 1, wherein said magnets have a minimum strength of 1000 gauss.

11. The magnetic treatment apparatus of claim 10, wherein said magnets have a minimum strength of 2000 gauss.

12. The magnetic treatment apparatus of claim 1, wherein said magnets are selected from the group of magnetic materials consisting of neodymium alloys, neodymium-iron-boron, selenium cobalt, and samarium cobalt alloys.

13. A method for the magnetic treatment of fluids and gaseous fuel mixtures within internal combustion engines comprising the steps of:

(a) orienting a plurality of magnets, said magnets orienting adjacent to each other so that the polarity ends of each magnet is oriented in close proximity to the polarity ends of each additional magnet of said plurality of magnets;

(b) providing a fuel atomizing chamber of an internal combustion engine, said fuel atomizing chamber having said plurality of magnets placed nearby and on opposing sides of said chamber; and (c) assembling a rigid enclosure for said plurality of magnets, said enclosure focusing the magnetic fields of said magnets toward the interior of said chamber.

14. The method of claim 13, wherein the step of orienting a plurality of magnets further comprising said magnets orienting the north polarity end of a first magnet is in close proximity to one polarity end of a second magnet, with each additional magnet of said plurality of magnets orienting so that the north polarity end is oriented in close proximity to one polarity end of the adjacent magnet.

15. The method of claim 14, wherein the step of providing said fuel atomizing chamber of an internal combustion engine, further comprising placing said plurality of magnets inside and on opposing sides of said chamber, said placing of magnets at a placement in said chamber at a point where the velocity of said fluids and gaseous fuel mixtures is at or near said maximum velocity of said mixtures in said chamber.

16. The method of claim 14, wherein the step of assembling said rigid enclosure further comprising securing said enclosure of said plurality of magnets in a configuration for focusing the magnet fields of each of said magnets into said fuel atomizing chamber.

17. The method of claim 13, wherein said plurality of magnets are focused at the point of maximum velocity of the fuel mixture through said fuel atomizing chamber.

* * * * *